US009428328B2

(12) United States Patent
Trombetta et al.

(10) Patent No.: US 9,428,328 B2
(45) Date of Patent: Aug. 30, 2016

(54) BEVERAGE CAPSULE

(75) Inventors: Liberatore A. Trombetta, Ancaster (CA); Christopher Douglas Meffen, Bolton (CA); Scott Hanneson, Mississauga (CA); Daud Ahmed Khan, Whitby (CA); YuCheng Fu, Guelph (CA); Dennis Dwight Paynter, Grapevine, TX (US)

(73) Assignee: 2266170 ONTARIO INC., Mississauga, ON (CA)

( * ) Notice: Subject to any disclaimer, the term of this patent is extended or adjusted under 35 U.S.C. 154(b) by 725 days.

(21) Appl. No.: 13/600,688

(22) Filed: Aug. 31, 2012

(65) Prior Publication Data

US 2013/0059039 A1 Mar. 7, 2013

Related U.S. Application Data

(60) Provisional application No. 61/530,041, filed on Sep. 1, 2011.

(51) Int. Cl.
*B65D 85/804* (2006.01)
*B65B 29/02* (2006.01)

(52) U.S. Cl.
CPC ..... *B65D 85/8043* (2013.01); *B65B 29/02* (2013.01)

(58) Field of Classification Search
CPC B65D 85/8043; B65D 85/804; B65B 29/02; B65B 29/06
USPC ..... 99/295; 426/77–79
See application file for complete search history.

(56) References Cited

U.S. PATENT DOCUMENTS

| | | | | |
|---|---|---|---|---|
| 2,113,715 | A | | 4/1938 | Wilcox |
| 2,778,739 | A | * | 1/1957 | Rodth ..... 426/77 |
| 2,987,221 | A | | 6/1961 | Milton |
| 3,110,121 | A | | 11/1963 | Corrinet |
| 3,282,703 | A | | 11/1966 | Broadhurst |
| 3,399,806 | A | | 9/1968 | Lucas |
| 3,713,936 | A | | 1/1973 | Ramsay |
| 4,101,627 | A | | 7/1978 | Menier |
| 4,131,064 | A | | 12/1978 | Ryan et al. |
| 4,220,673 | A | | 9/1980 | Strobel |
| 4,235,160 | A | | 11/1980 | Olney et al. |

(Continued)

FOREIGN PATENT DOCUMENTS

| | | |
|---|---|---|
| CA | 2012891 | 9/1991 |
| CA | 2276927 | 1/2000 |

(Continued)

*Primary Examiner* — Erik Kashnikow
*Assistant Examiner* — Chaim Smith
(74) *Attorney, Agent, or Firm* — Manelli Selter PLLC; Edward J. Stemberger

(57) ABSTRACT

A beverage capsule has a body, a filter disposed in the body, ingredients disposed in the filter and a cover. The body includes a side wall that extends from an end wall to an opening that is covered by the cover. A boss extends into the interior space from the end wall inwardly of an extraction region. In one embodiment, the boss defines an engagement surface having a plurality of arms for engaging a bottom portion of the filter during use. In another embodiment, the boss engages the filter to define a tented filter zone wherein an inner portion of the filter is spaced a further distance from the end wall than an outer portion of the filter. In another embodiment, a diffusing surface is disposed in the body downstream of where a fluid is intended to enter the opening of the capsule during use with a beverage preparing machine.

15 Claims, 7 Drawing Sheets

(56) References Cited

U.S. PATENT DOCUMENTS 4,306,367 A 12/1981 Otto
4,440,796 A 4/1984 Lunder et al.
4,471,689 A 9/1984 Piana
4,518,639 A 5/1985 Phillips
4,559,729 A 12/1985 White
4,619,830 A 10/1986 Napier
4,701,365 A 10/1987 Iwsaki
4,728,425 A 3/1988 Sandvig
4,859,337 A 8/1989 Woltermann
4,865,737 A 9/1989 McMichael
4,867,993 A 9/1989 Nordskog
4,981,588 A 1/1991 Poulallion
4,983,410 A 1/1991 Dinos
4,995,310 A 2/1991 van der Lijn et al.
4,996,066 A 2/1991 Love et al.
5,008,013 A 4/1991 Favre et al.
5,076,433 A 12/1991 Howes
5,298,267 A 3/1994 Gruenbacher
5,331,793 A 7/1994 Pophal et al.
5,390,587 A 2/1995 Wu
5,447,631 A 9/1995 Mahlich
5,456,929 A 10/1995 Mifune et al.
5,496,573 A 3/1996 Tsuji et al.
5,536,290 A 7/1996 Stark et al.
5,575,383 A 11/1996 Seeley
5,601,716 A 2/1997 Heinrich et al.
5,605,710 A 2/1997 Pridonoff et al.
5,738,786 A 4/1998 Winnington-Ingram
5,806,582 A 9/1998 Howes
5,840,189 A 11/1998 Sylvan et al.
5,858,437 A 1/1999 Anson
5,866,185 A 2/1999 Burkett
5,871,096 A 2/1999 Yakich
5,871,644 A 2/1999 Simon et al.
5,882,716 A 3/1999 Munz-Schaerer et al.
5,885,314 A 3/1999 Oussoren et al.
5,895,672 A 4/1999 Cooper
5,896,686 A 4/1999 Howes
5,897,899 A 4/1999 Fond
5,923,242 A 7/1999 Slagle et al.
5,957,279 A 9/1999 Howes
5,971,195 A 10/1999 Reidinger et al.
6,025,000 A 2/2000 Fond et al.
6,146,270 A 11/2000 Huard et al.
6,189,438 B1 2/2001 Bielfeldt et al.
6,220,147 B1 4/2001 Priley
6,223,937 B1 5/2001 Schmidt
6,440,256 B1 8/2002 Gordon et al.
6,514,555 B1 2/2003 Fayard et al.
6,548,433 B1 4/2003 Gbur et al.
6,557,597 B2 5/2003 Riesterer
6,561,232 B1 5/2003 Frutin
6,589,577 B2 7/2003 Lazaris et al.
6,607,762 B2 8/2003 Lazaris et al.
6,622,615 B2 9/2003 Heczko
6,644,173 B2 11/2003 Lazaris et al.
6,645,537 B2 11/2003 Sweeney et al.
6,658,989 B2 12/2003 Sweeney et al.
6,720,070 B2 4/2004 Hamaguchi et al.
6,758,130 B2 7/2004 Sargent et al.
6,810,788 B2 11/2004 Hale
6,841,185 B2 1/2005 Sargent et al.
6,854,378 B2 2/2005 Jarisch et al.
6,869,627 B2 3/2005 Perkovic et al.
6,913,777 B2 7/2005 Rebhorn et al.
6,959,832 B1 11/2005 Sawada
6,992,586 B2 1/2006 Rosenfeld
7,067,038 B2 6/2006 Trokhan et al.
7,153,530 B2 12/2006 Masek et al.
7,279,188 B2 10/2007 Arrick et al.
7,311,209 B2 12/2007 Bentz et al.
7,325,479 B2 2/2008 Laigneau et al.
7,328,651 B2 2/2008 Halliday et al.
7,387,063 B2 6/2008 Vu et al.
7,412,921 B2 8/2008 Hu et al.
7,444,925 B2 11/2008 Machlich
7,490,542 B2 2/2009 Macchi et al.
7,543,527 B2 6/2009 Schmed
7,552,672 B2 6/2009 Schmed
7,552,673 B2 6/2009 Levin
7,594,470 B2 9/2009 Scarchilli et al.
7,624,673 B2 12/2009 Zanetti
7,640,842 B2 1/2010 Bardazzi
7,681,492 B2 3/2010 Suggi Liverani et al.
7,685,930 B2 3/2010 Mandralis et al.
7,698,992 B2 4/2010 Wei
7,763,300 B2 7/2010 Sargent et al.
7,798,055 B2 9/2010 Mandralis et al.
7,854,192 B2 12/2010 Denisart et al.
7,856,920 B2 12/2010 Schmed et al.
7,856,921 B2 12/2010 Arrick et al.
7,910,145 B2 3/2011 Reati
8,062,682 B2 11/2011 Mandralis et al.
8,225,771 B2 7/2012 Aso et al.
8,286,547 B1 10/2012 Lassota
8,361,527 B2 1/2013 Winkler et al.
8,409,646 B2 4/2013 Yoakim et al.
8,425,957 B2 4/2013 Steenhof
8,474,368 B2 7/2013 Kilber et al.
8,475,854 B2 7/2013 Skalski et al.
8,481,097 B2 7/2013 Skalski et al.
8,573,114 B2 11/2013 Huang et al.
8,591,978 B2 11/2013 Skalski et al.
8,673,379 B2 3/2014 Skalski et al.
8,740,020 B2 6/2014 Marina et al.
8,834,948 B2 9/2014 Estabrook et al.
2002/0020659 A1 2/2002 Sweeney et al.
2002/0148358 A1* 10/2002 Sweeney ..... A47J 31/0642 99/306
2003/0005826 A1 1/2003 Sargent et al.
2003/0039731 A1 2/2003 Dalton et al.
2003/0087005 A1 5/2003 Baron
2005/0016383 A1 1/2005 Kirschner et al.
2005/0051478 A1 3/2005 Karanikos et al.
2005/0287251 A1 12/2005 Lazaris et al.
2006/0236871 A1 10/2006 Ternite et al.
2006/0246187 A1 11/2006 Egolf et al.
2007/0144356 A1 6/2007 Rivera
2007/0148290 A1 6/2007 Ternite
2007/0275125 A1 11/2007 Catani
2008/0015098 A1 1/2008 Littlejohn et al.
2008/0142115 A1 6/2008 Vogt et al.
2008/0156196 A1 7/2008 Doglioni Majer
2008/0202075 A1 8/2008 Kronawittleithner et al.
2008/0245236 A1 10/2008 Ternite et al.
2009/0110775 A1 4/2009 Rijskamp et al.
2009/0133584 A1 5/2009 De Graaff et al.
2009/0165228 A1 7/2009 Kilkenny
2009/0175986 A1 7/2009 Doglioni Majer
2009/0186141 A1 7/2009 Almblad et al.
2009/0206084 A1 8/2009 Woolf et al.
2009/0211458 A1 8/2009 Denisart et al.
2009/0260690 A1 10/2009 Bell
2009/0311389 A1 12/2009 Zoss et al.
2009/0324791 A1 12/2009 Ohresser et al.
2010/0003379 A1 1/2010 Zoss et al.
2010/0028495 A1 2/2010 Novak et al.
2010/0116772 A1 5/2010 Teys
2010/0173056 A1* 7/2010 Yoakim et al. ..... 426/433
2010/0215808 A1 8/2010 Versini
2010/0239733 A1 9/2010 Yoakim et al.
2010/0303964 A1 12/2010 Beaulieu et al.
2011/0003040 A1 1/2011 Graf et al.
2011/0033580 A1 2/2011 Biesheuvel et al.
2011/0041699 A1 2/2011 Hale
2011/0045144 A1 2/2011 Boussemart et al.
2011/0064852 A1* 3/2011 Mann ..... 426/78
2011/0076361 A1 3/2011 Peterson et al.
2011/0183048 A1 7/2011 Noble et al.
2011/0185911 A1 8/2011 Rapparini
2011/0247975 A1 10/2011 Rapparini
2012/0006205 A1 1/2012 Vanni
2012/0024160 A1 2/2012 Van Os et al.
2012/0052163 A1 3/2012 Doleac et al.

(56) References Cited

U.S. PATENT DOCUMENTS

| | | | |
|---|---|---|---|
| 2012/0070542 | A1 | 3/2012 | Camera et al. |
| 2012/0097602 | A1 | 4/2012 | Tedford |
| 2012/0121764 | A1 | 5/2012 | Lai et al. |
| 2012/0171334 | A1 | 7/2012 | Yoakim |
| 2012/0174794 | A1 | 7/2012 | Fraij |
| 2012/0180670 | A1 | 7/2012 | Yoakim |
| 2012/0180671 | A1 | 7/2012 | Baudet |
| 2012/0183649 | A1 | 7/2012 | Burkhalter |
| 2012/0186457 | A1 | 7/2012 | Ozanne |
| 2012/0196008 | A1 | 8/2012 | York |
| 2012/0199007 | A1 | 8/2012 | Larzul |
| 2012/0199010 | A1 | 8/2012 | Mariller |
| 2012/0199011 | A1 | 8/2012 | Cheng |
| 2012/0201933 | A1 | 8/2012 | Dran et al. |
| 2012/0207893 | A1 | 8/2012 | Kreuger |
| 2012/0207894 | A1 | 8/2012 | Webster |
| 2012/0210876 | A1 | 8/2012 | Glucksman |
| 2012/0210878 | A1 | 8/2012 | Mariller |
| 2012/0210879 | A1 | 8/2012 | Mariller |
| 2012/0231123 | A1 | 9/2012 | Kamerbeek |
| 2012/0231124 | A1 | 9/2012 | Kamerbeek |
| 2012/0231126 | A1 | 9/2012 | Lo Faro |
| 2012/0231133 | A1 | 9/2012 | Kamerbeek |
| 2012/0251668 | A1 | 10/2012 | Wong |
| 2012/0251669 | A1 | 10/2012 | Kamerbeek |
| 2012/0251670 | A1 | 10/2012 | Kamerbeek |
| 2012/0251671 | A1 | 10/2012 | Kamerbeek |
| 2012/0251692 | A1 | 10/2012 | Kamerbeek |
| 2012/0251693 | A1 | 10/2012 | Kamerbeek |
| 2012/0251694 | A1 | 10/2012 | Kamerbeek |
| 2012/0258204 | A1 | 10/2012 | Tsuji |
| 2012/0258210 | A1 | 10/2012 | Wong |
| 2012/0258219 | A1 | 10/2012 | Wong |
| 2012/0258221 | A1 | 10/2012 | Wong |
| 2012/0260806 | A1 | 10/2012 | Rolfes |
| 2012/0263829 | A1 | 10/2012 | Kamerbeek |
| 2012/0263830 | A1 | 10/2012 | Kamerbeek |
| 2012/0263833 | A1 | 10/2012 | Wong |
| 2012/0266755 | A1 | 10/2012 | Baudet |
| 2012/0269933 | A1 | 10/2012 | Rapparini |
| 2012/0272830 | A1 | 11/2012 | Gugerli |
| 2012/0276252 | A1 | 11/2012 | Bunke |
| 2012/0276255 | A1 | 11/2012 | Verbeek |
| 2012/0297987 | A1 | 11/2012 | Lee |
| 2012/0301581 | A1 | 11/2012 | Abegglen |
| 2012/0307024 | A1 | 12/2012 | Howes |
| 2012/0308688 | A1 | 12/2012 | Peterson |
| 2012/0312174 | A1 | 12/2012 | Lambert |
| 2012/0321755 | A1 | 12/2012 | Macaulay |
| 2012/0321756 | A1 | 12/2012 | Estabrook et al. |
| 2012/0328739 | A1 | 12/2012 | Nocera |
| 2012/0328740 | A1 | 12/2012 | Nocera |
| 2012/0328744 | A1 | 12/2012 | Nocera |
| 2013/0004629 | A1 | 1/2013 | Clark |
| 2013/0004637 | A1 | 1/2013 | Gugerli |
| 2013/0008316 | A1 | 1/2013 | Hoeglauer |
| 2013/0011521 | A1 | 1/2013 | Weijers et al. |
| 2013/0017303 | A1 | 1/2013 | Vu |
| 2013/0025466 | A1 | 1/2013 | Fu |
| 2013/0032034 | A1 | 2/2013 | Jarisch |
| 2013/0047863 | A1 | 2/2013 | Larzul |
| 2013/0055903 | A1 | 3/2013 | Deuber |
| 2013/0059039 | A1 | 3/2013 | Trombetta |
| 2013/0068109 | A1 | 3/2013 | Pribus et al. |
| 2013/0084368 | A1 | 4/2013 | Linck et al. |
| 2013/0095219 | A1 | 4/2013 | de Graaff et al. |
| 2013/0115342 | A1 | 5/2013 | Van Os et al. |
| 2013/0122153 | A1 | 5/2013 | Ferrier et al. |
| 2013/0122167 | A1 | 5/2013 | Winkler et al. |
| 2013/0142931 | A1 | 6/2013 | Fin et al. |
| 2013/0259982 | A1 | 10/2013 | Abegglen et al. |
| 2013/0340626 | A1 | 12/2013 | Oh |
| 2013/0344205 | A1 | 12/2013 | Oh |
| 2014/0013958 | A1 | 1/2014 | Krasne et al. |
| 2014/0037802 | A1 | 2/2014 | Cardoso |
| 2014/0099388 | A1 | 4/2014 | Wang et al. |

FOREIGN PATENT DOCUMENTS

| | | | |
|---|---|---|---|
| CA | 2516417 | A1 | 9/2004 |
| CA | 2517840 | | 8/2005 |
| CA | 2689804 | A1 | 3/2008 |
| CA | 2686347 | A1 | 12/2008 |
| CA | 2807489 | | 2/2012 |
| CA | 2824199 | A1 | 8/2012 |
| CA | 2759782 | A1 | 11/2012 |
| CA | 2810236 | A1 | 3/2013 |
| CN | 202537195 | | 11/2012 |
| CN | 202960136 | | 6/2013 |
| EP | 0145499 | | 8/1981 |
| EP | 0047169 | A2 | 3/1982 |
| EP | 0432126 | A1 | 6/1991 |
| EP | 1593329 | | 11/2005 |
| EP | 1859683 | | 11/2007 |
| EP | 2230195 | | 9/2010 |
| EP | 2345351 | | 7/2011 |
| EP | 2409608 | | 1/2012 |
| EP | 1208782 | | 8/2014 |
| FR | 2930522 | A1 | 10/2009 |
| GB | 803486 | A | 10/1958 |
| GB | 962038 | | 6/1964 |
| GB | 2074838 | | 11/1981 |
| JP | 662737 | | 3/1994 |
| JP | 11171249 | A | 6/1999 |
| KR | 20140031693 | | 3/2014 |
| WO | 9212660 | | 8/1992 |
| WO | 0145616 | A1 | 6/2001 |
| WO | 03082065 | A1 | 10/2003 |
| WO | 2004083071 | A1 | 9/2004 |
| WO | 2009114119 | | 9/2009 |
| WO | 2010013146 | A2 | 2/2010 |
| WO | 2010066705 | | 6/2010 |
| WO | 2010085824 | | 8/2010 |
| WO | 2010006516 | A1 | 9/2010 |
| WO | 2010137956 | A1 | 12/2010 |
| WO | 2011095518 | | 8/2011 |
| WO | 2012031106 | A1 | 3/2012 |
| WO | 2012069505 | | 5/2012 |
| WO | 2014056862 | | 4/2014 |
| WO | 2014112556 | | 12/2014 |

* cited by examiner

BEVERAGE CAPSULE

FIELD

This specification relates to beverage capsules and in particular to beverage capsules adapted for use with beverage preparing machines.

BACKGROUND

The following background discussion is not an admission that anything discussed below is citable as prior art or common general knowledge. The documents listed below are incorporated herein in their entirety by this reference to them.

Beverage capsules containing filters and ingredients for use with beverage preparing machines are well known. A fluid, such as hot water, is injected into the beverage capsule using the beverage preparing machine in order that the fluid may mix with the ingredients to form a desired beverage. The desired beverage then flows through the filter and exits the capsule through an opening that is formed in the capsule downstream of the filter.

One problem with such capsules is that the flow of fluid through the filter may be slowed or impeded by fines that collect in the filter. The fines comprise small particles of ingredients that may block some or all of the pores or openings of the filter.

Another problem with such capsules is that the flow of fluid injected into the capsule may be concentrated along a particular path (such as the central axis of the capsule where the fluid is injected) with the result that the fluid does not sufficiently saturate all of the ingredients contained within the capsule.

There is a need for an improved beverage capsule that addresses the above problems or that otherwise provides advantages over conventional capsules.

SUMMARY

In one aspect the invention provides a beverage capsule intended for use in a beverage preparing machine, said beverage capsule comprising:

a body having a side wall extending from an end wall to an opening to define an interior space, said end wall including an extraction region that is adapted to be pierced to facilitate flow of beverage from said capsule;

a filter disposed in said body to define an ingredients chamber, located between said opening and said filter, and an extraction chamber located between said filter and said end wall;

a boss extending from said end wall into said interior space, said boss defining an engagement surface having a plurality of arms for engaging a bottom surface of said filter during use;

one or more ingredients disposed in said ingredients chamber for preparing a desired beverage; and a cover for covering said opening.

In another aspect the invention provides a beverage capsule intended for use in a beverage preparing machine, said beverage capsule comprising:

a body having a sidewall extending from an end wall to an opening; and a filter disposed in said body, said filter having an inner portion and an outer portion where the inner portion is spaced a greater distance from said end wall than the distance said outer portion is spaced from said end wall.

In another aspect the invention provides a beverage capsule intended for use in a beverage preparing machine, said beverage capsule comprising:

a body having a side wall extending from an end wall to an opening;

a diffusing surface disposed in said body downstream of where a fluid is intended to enter the opening of said capsule during use with a beverage preparing machine, said diffusing surface being adapted to redirect fluid that engages said diffusing surface to desired locations within said capsule.

In another aspect the invention provides a beverage capsule intended for use in a beverage preparing machine, said beverage capsule comprising:

a body having a side wall extending from an end wall to an opening to define an interior space, said end wall including an extraction region that is adapted to be pierced to facilitate flow of beverage from said capsule;

a filter disposed in said body to define an ingredients chamber, located between said opening and said filter, and an extraction chamber located between said filter and said end wall;

a boss extending from said end wall into said interior space, said boss engaging said filter to define a tented filter zone wherein an inner portion of said filter is spaced a further distance from said end wall than an outer portion of said filter;

one or more ingredients disposed in said ingredients chamber for preparing a desired beverage; and a cover for covering said opening.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Figure 1:
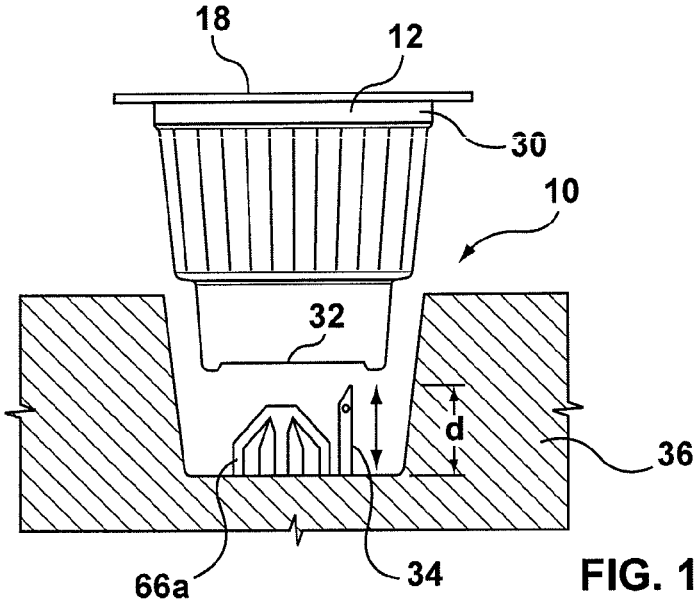
FIG. 1 is front view of a beverage capsule in accordance with the present invention.

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A beverage capsule in accordance with the present invention is shown generally at 10 in the FIGS. Beverage capsule 10 includes a body 12, filter 14, ingredients 16 and cover 18.

Body 12 includes a side wall 20 and an end wall 22 together defining an interior space 24. An opening 26 is defined at one end of body 12. A flange 28 extends around the perimeter of opening 26 and a stacking ring 30 (if required) is defined in side wall 20 below flange 28.

End wall 22 includes an extraction region 32 adapted for being pierced by an extraction needle 34 of a beverage preparing machine 36. Extraction needle 34 is adapted to extend a maximum distance d into body 12 from end wall 22.

Figure 9:
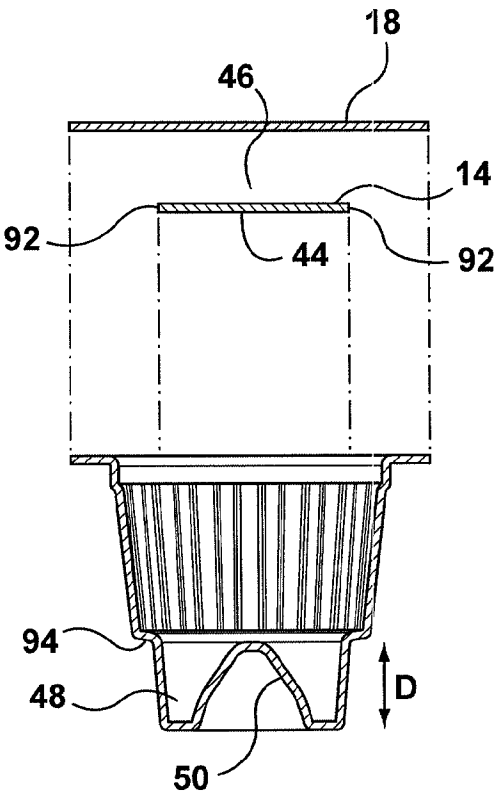
FIG. 9 is an exploded sectional view of a beverage capsule in accordance with another embodiment of the present invention.
Figure 8:
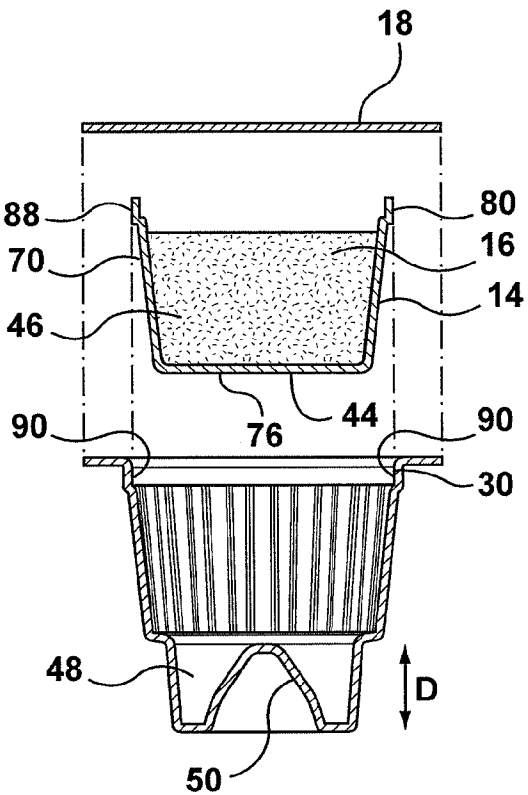
FIG. 8 is an exploded sectional view of a beverage capsule in accordance with another embodiment of the present invention.
Figure 7:
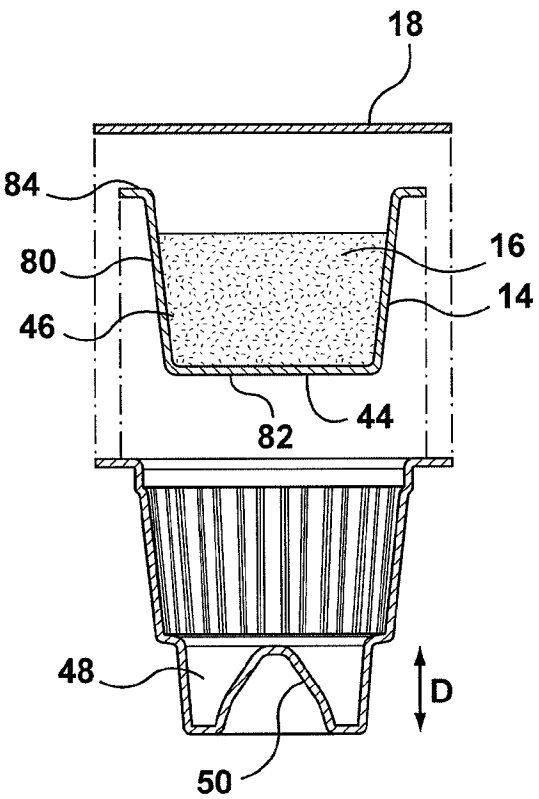
FIG. 7 is an exploded sectional view of a beverage capsule in accordance with one embodiment of the present invention.

As shown in FIGS. 7-9, filter 14 is adapted to be disposed within body 12 to define at least one ingredients chamber 46 in an upper region of said interior space for receiving one or more ingredients and at least one extraction chamber 48 in a lower region of said interior space for receiving beverage from said at least one ingredients chamber 46 prior to extraction using said extraction needle 34. Filter 14 includes a bottom portion 44 that is preferably disposed a distance D from end wall 22 that is sufficient to prevent filter 14 from being pierced or torn by extraction needle 34 during use.

Ingredients 16 may be coffee grounds, tea leaves, chocolate powder, milk powder, instant coffee or any other ingredients or combinations of ingredients that may be used to prepare a beverage in a beverage preparing machine 36 as described herein. Ingredients 16 have a desired particle size range however it is common for fines 16*a* (particles much smaller than the desired range), to be present in ingredients 16. In conventional capsules, fines 16*a* tend to collect at the lowest most regions of the filter 14 and may block the pores of the filter 14 to such an extent as to slow down or stop the flow of beverage through the filter 14.

Filter 14 may be formed of any food grade filter material suitable for filtering the ingredients under the conditions of use for the beverage preparing machine. Paper or synthetic filter materials (polymers or biopolymers) are preferred with non-woven filter materials being most preferred.

Figure 10:
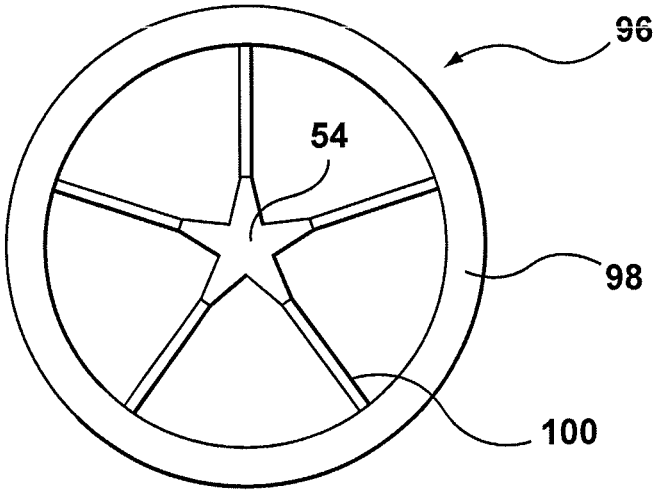
FIG. 10 is a top view of a filter support disc for a beverage capsule in accordance with another embodiment of the present invention.
Figure 11:
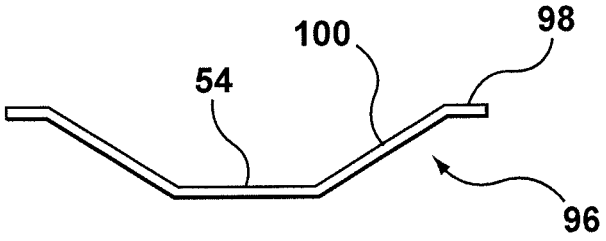
FIG. 11 is a side view of the filter support disc shown in FIG. 10.
Figure 12:
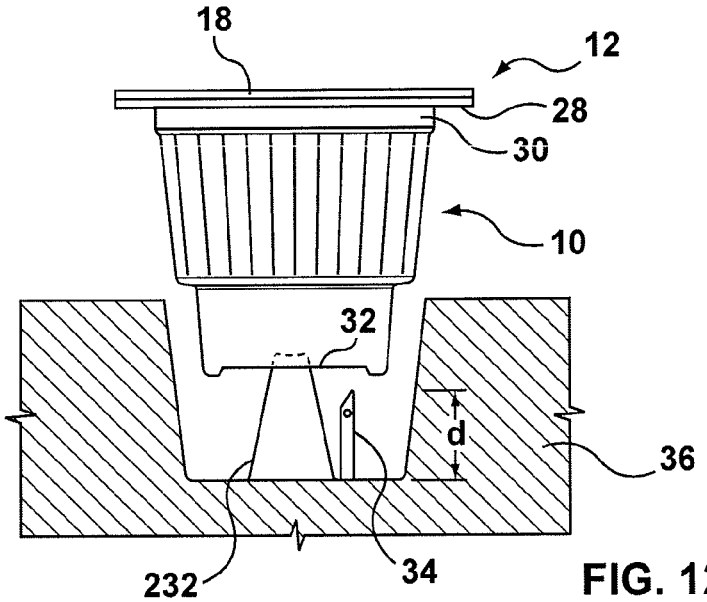
FIG. 12 is front view of another embodiment of beverage capsule in accordance with the present invention.

Body 12 includes a boss 50 that extends into interior space 24 from end wall 22 inwardly of extraction region 32. Boss 50 is preferably integrally formed with end wall 22 but may alternatively be formed as a separate piece that is supported within body 12 as shown in FIGS. 10 and 11.

Figure 4:
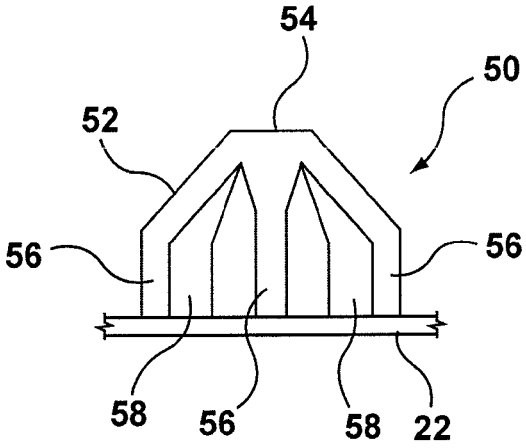
FIG. 4 is an enlarged perspective view of the boss for the body shown in FIG. 2.

Referring to FIG. 4, boss 50 includes a side wall 52 that slopes upwardly and inwardly from end wall 22 to an engagement surface 54. Engagement surface 54 is adapted to engage bottom portion 44 of filter 14 when filter 14 becomes saturated during use of beverage capsule 10. Preferably, engagement surface 54 is disposed at the same distance from end wall 22 as the bottom portion of filter 14 plus or minus a few millimeters.

Preferably engagement surface 54 is relatively flat and extends generally parallel to end wall 22. However, engagement surface 54 may instead be dimpled, scored or otherwise profiled. Also, engagement surface 54 may extend at an incline or a curve relative to end wall 22.

Figure 2:
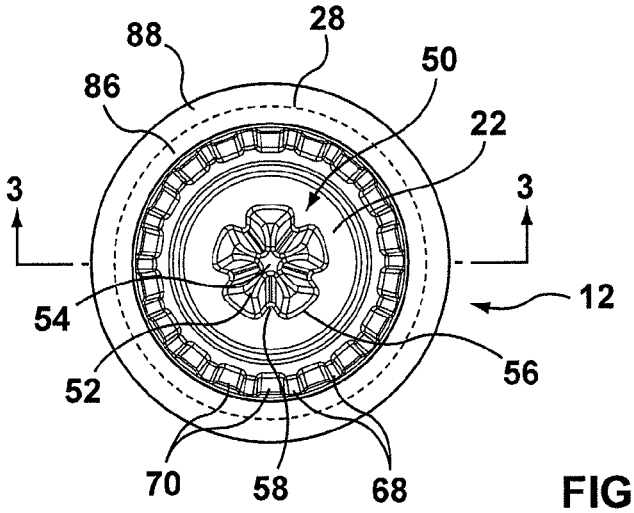
FIG. 2 is a top view of a body of a beverage capsule in accordance with the present invention.
Figure 3:
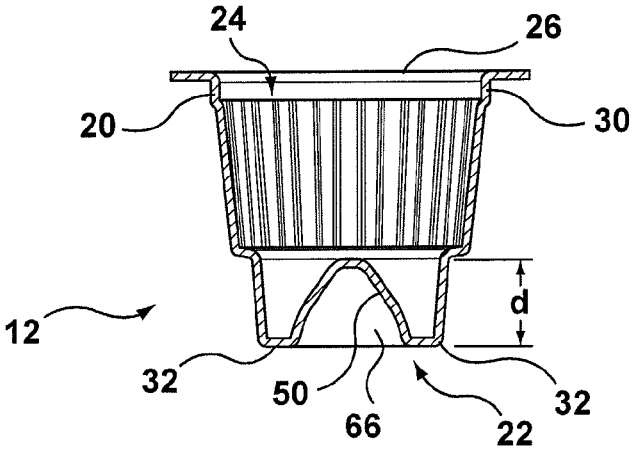
FIG. 3 is a sectional view of the body shown in FIG. 2 as viewed along lines 3-3.

Engagement surface 54 includes a plurality of arms 56 that define voids 58 between respective arms 56. Boss 50 preferably is a frustum that is star shaped in cross section or top view as shown in FIG. 2. Other cross sectional shapes may also be suitable including cross shapes or triangular shapes provided that at least one void 58 is defined between arms 56.

Figure 5:
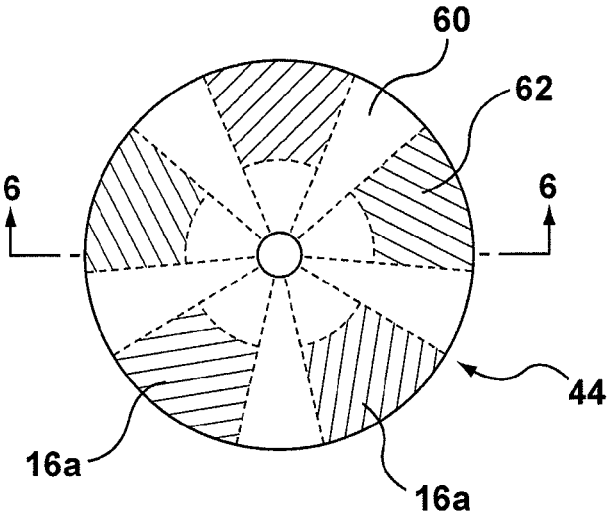
FIG. 5 is a top view of the filter bottom for the beverage capsule of FIG. 1 showing the distribution of fines following use.
Figure 6:
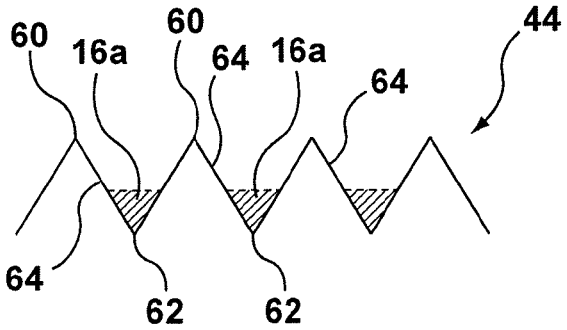
FIG. 6 is a sectional view of the filter bottom of FIG. 5 as viewed along lines 6-6.

Referring to FIGS. 5 and 6, when filter 14 and ingredients 16 become saturated during use of beverage capsule 10 in beverage preparing machine 36, bottom portion 44 sags onto engagement surface 54 over arms 56 and at least partially into voids 58. As a result, a series of peaks 60, valleys 62 and slopes 64 are formed in bottom portion 44. As fluid is introduced into capsule 10 centrally through cover 18, fluid tends to form eddies and carry fines 16*a* to the peripheral regions of filter 14. Fines 16*a* tend to settle and collect within valleys 62 particularly at the periphery of bottom portion 44. This ensures that the remainder of bottom portion 44 is sufficiently clear of fines 16*a* to allow beverage to flow at a desired rate.

In addition to providing collection zones in valleys 62 for fines 16*a*, it is believed that contact between bottom portion 44 of filter 14 and engagement surface 54 of boss 50 encourages fluid flow through filter 14 in a similar manner as contact between one's finger and the walls of a tent encourages flow of water through the tent wall. It is believed that the plurality of arms 56 and voids 58 aid in increasing the surface tension at bottom portion 44 of filter 14 as filter 14 becomes saturated during use. The increased surface tension further opens the pores of filter 14 to encourage fluid flow particularly at the location of voids 58.

Boss 50 preferably defines a corresponding recess 66 on outer surface of end wall 22 that may be adapted to fit with a corresponding shaped key 66*a* extending from the beverage preparing machine 36. The recess 66 aids in aligning capsule 10 in a desired orientation within beverage preparing machine 36 and also provides an opportunity for capsules 12 to be adapted for use only with machines 36 having corresponding keys 66*a*.

Body 12 may also include channels 68 defined in side wall 14 between upper and lower regions of the interior space of capsule 10 to facilitate air and fluid flow between the regions. Channels 68 may be defined between ribs 70 that provide additional rigidity to side wall 14. The added rigidity of ribs 70 allows capsule 10 to be better suited to withstand forces associated with manufacturing, handling, and brewing. Channels 68 and ribs 70 are optional elements however and side wall 14 of body 12 may have other configurations including the flat sided configuration seen with conventional beverage capsules.

Referring to one embodiment of capsule 10 as shown in FIG. 7, filter 14 is generally cylindrical in shape with a filter side wall 80 and filter bottom 82. Filter 14 also includes a gasket 84, preferably integrally formed with filter 14, for securing filter 14 to flange 28 of body 12 to support filter 14 within capsule 10. Gasket 84 may be formed of a material having a higher melt temperature than flange 28 and cover 18 to allow the elements to be heat sealed together. Alternatively, flange 28 may be larger in diameter than gasket 84 (as shown in FIG. 2) in order to define a first region 86 for securing filter 14 to flange 28 and a second region 88 located radially outwards from first region 86 for securing cover 18 to flange 28.

Referring to another embodiment of capsule 10 as shown in FIG. 8, filter 14 has a peripheral edge 88 (instead of gasket 84) that is secured to an attachment surface 90 defined on side wall 14 at an upper inside portion of body 12 such as at stacking ring 30.

Referring to another embodiment of capsule 10 as shown in FIG. 9, filter 14 is generally disc shaped and has a peripheral edge 92 secured to a ledge 94 defined on side wall 14 of body 12.

Referring to FIGS. 10 and 11, a filter support disc 96 is shown. Filter support disc 96 is adapted to be supported on ledge 94 of body for supporting a filter 14. Filter support disc 96 includes a ring 98 that is sized to be secured to ledge 94. Spokes 100 extend inwardly from ring 98 to support engagement surface 54. Engagement surface 54 acts in a similar manner as described above to engage a bottom portion of filter 14 to encourage flow of fluid there through. Spokes 100 may extend at an incline (as shown in FIG. 11) if necessary to support engagement surface 54 at a desired level so as to engage bottom portion 44 of filter 14 once it becomes saturated. Preferably, engagement surface 54 is disposed at the same distance from end wall 22 as the bottom portion of filter 14 plus or minus a few millimeters Referring to FIGS. 12 to 19, other embodiments of beverage capsule are shown. The same reference numerals are used to refer to similar elements as described above.

Figure 18:
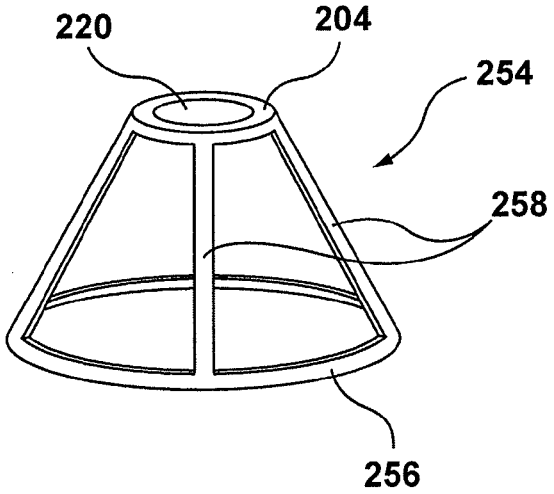
FIG. 18 is a perspective view of a boss element adapted to rest on the end wall of a beverage capsule in accordance with another embodiment of the present invention.

Body 12 includes a boss 200 that extends into interior space 24 from end wall 22 inwardly of extraction region 32. Boss 200 is preferably integrally formed with end wall 22 but may alternatively be formed as a separate element that is supported within body 12 as shown in FIG. 18. Boss 200 preferably is shaped as a frustum and most preferably is frustoconical or polygonal.

Figure 15:
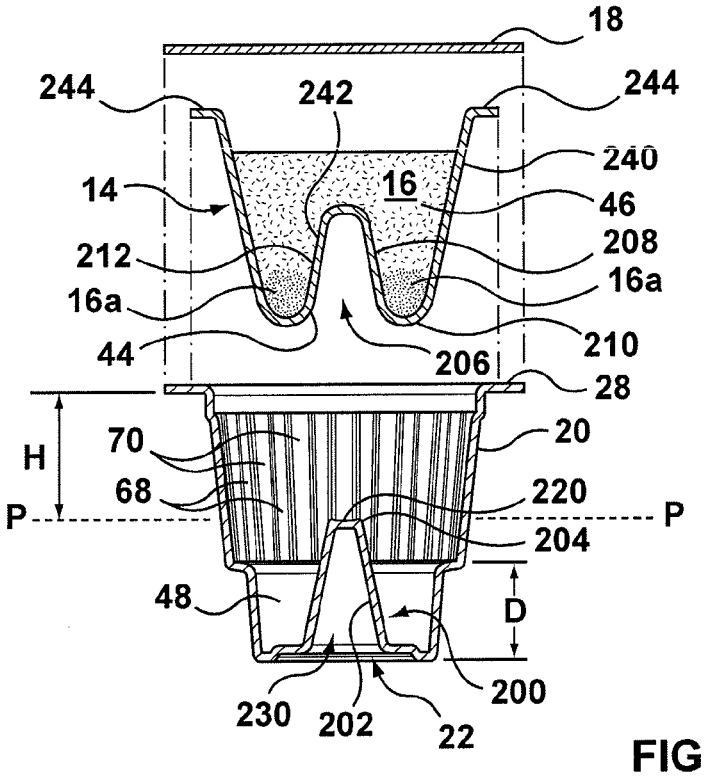
FIG. 15 is an exploded sectional view of a beverage capsule in accordance with another embodiment of the present invention.
Figure 16:
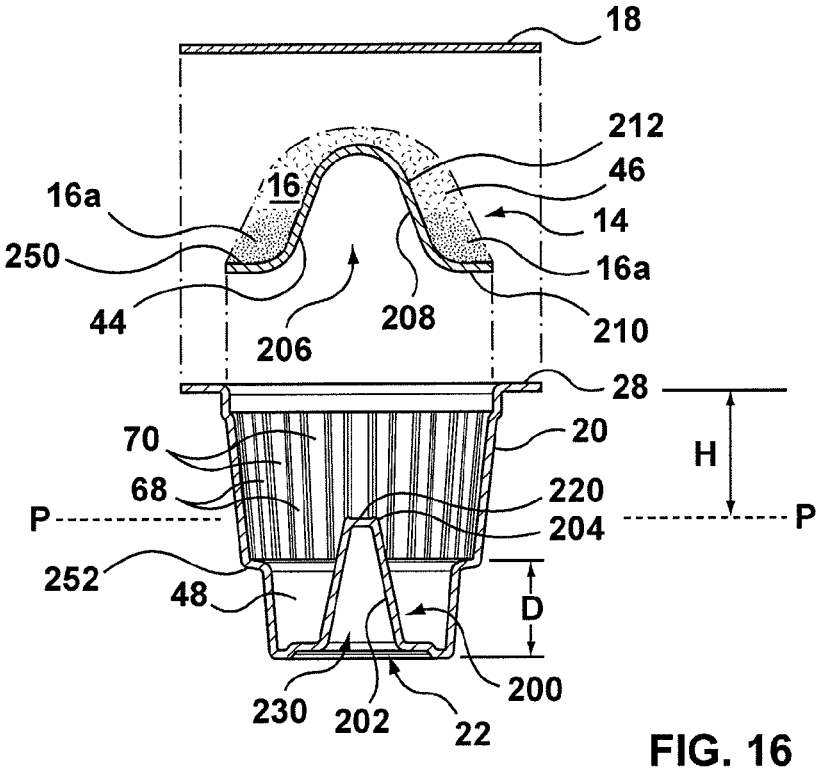
FIG. 16 is an exploded sectional view of a beverage capsule in accordance with another embodiment of the present invention.

Referring to FIGS. 15 and 16, boss 200 includes a side wall 202 that slopes upwardly and inwardly from end wall 22 to a tip 204. Boss 200 is adapted to support a portion of filter 14 to define a tented filter zone 206 within interior space 24. Tented filter zone 206 includes a raised inner portion 208 of filter 14 that is spaced a greater distance from end wall 22 than a lower outer portion 210 of filter 14.

As fluid is introduced into capsule 10 centrally through cover 18, fluid tends to form eddies and carry fines 16*a* to the peripheral regions of bottom portion of filter 14. Fines 16*a* tend to settle and collect at the lower outer portion 210 of filter 14. Tented filter zone 206 includes an inclined filter wall 212 that ensures that the remainder of bottom portion 44 is sufficiently clear of fines 16*a* to allow beverage to flow at a desired rate.

Figure 19:
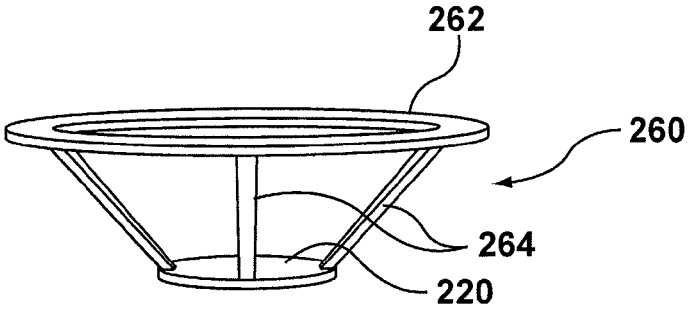
FIG. 19 is a perspective view of a diffusing element adapted to rest on the flange of a beverage capsule in accordance with another embodiment of the present invention.

Tip 204 preferably defines a diffusing surface 220 to engage and diffuse a laminar stream of fluid that enters capsule 10 for optimum saturation of ingredients within capsule 10. Diffusing surface 220 may be integrally formed with tip 204 or it may be disposed as a separate element within capsule 10 as shown in FIG. 19. Diffusing surface 220 preferably is concave in shape but other suitable diffusing structures may be utilized.

For beverage preparing machines having a central nozzle that directs fluid in a laminar stream into the capsule 10, diffusing surface 220 is preferably sized to engage the entire stream of fluid without occupying more space than is necessary within capsule 10. Preferably, diffusing surface 220 has a cross-sectional area that is no greater than 20% of the cross-sectional area of interior space of capsule 10 as measured in a plane P in which diffusing surface 220 is located. It is also preferable that diffusing surface 220 is disposed at a height within capsule 10 that optimizes the saturation of ingredients within the capsule without occupying more space than is necessary within capsule. Preferably, diffusing surface 220 is spaced a distance H from opening that is no less than 20% and no more than 80% of the overall height of capsule 10 as measured from end wall 22 to opening 24.

Boss 200 preferably defines a recess 230 on an outer surface of end wall 22 that may be adapted to fit with a corresponding shaped key 232 extending from the beverage preparing machine 36. The recess 230 aids in aligning capsule 10 in a desired orientation within beverage preparing machine 36 and also provides an opportunity for capsules 12 to be adapted for use only with machines 36 having corresponding keys 232.

Figure 13:
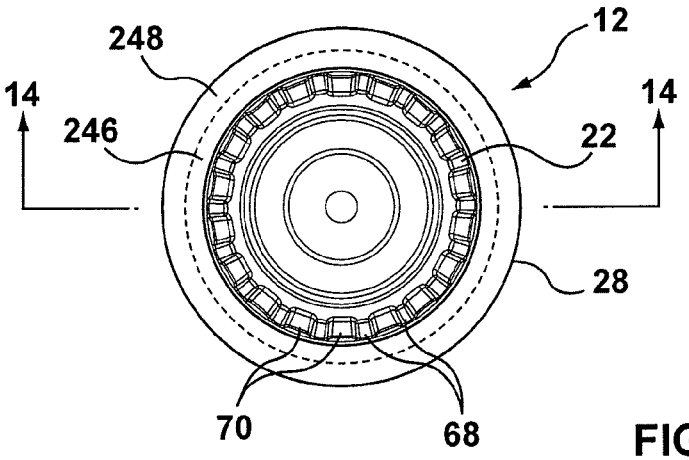
FIG. 13 is a top view of a body of another embodiment of beverage capsule in accordance with the present invention.
Figure 14:
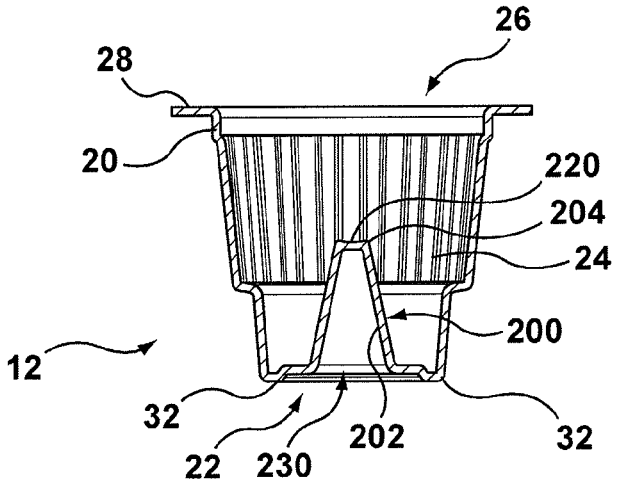
FIG. 14 is a sectional view of the body shown in FIG. 13 as viewed along lines 14-14.

Referring to one embodiment of capsule 10 as shown in FIG. 15, filter 14 includes a filter side wall 240 and filter bottom 242 having tented filter zone 206 defined therein. Filter 14 also includes a gasket 244 for securing filter 14 to flange 28 of body 12 to support filter 14 within capsule 10. Gasket 244 may be formed of a material having a higher melt temperature than flange 28 and cover 18 to allow the elements to be heat sealed together. Alternatively, flange 28 may be larger in diameter than gasket 244 (as shown in FIG. 13) in order to define a first region 246 for securing filter 14 to flange 28 and a second region 248 located radially outwards from first region 246 for securing cover 18 to flange 28.

Referring to another embodiment of capsule 10 as shown in FIG. 16, filter 14 has a peripheral edge 250 secured to a ledge 252 defined on side wall 20 of body 12 with tented filter zone 206 defined in filter 14 inwardly of peripheral edge 250.

Figure 17:
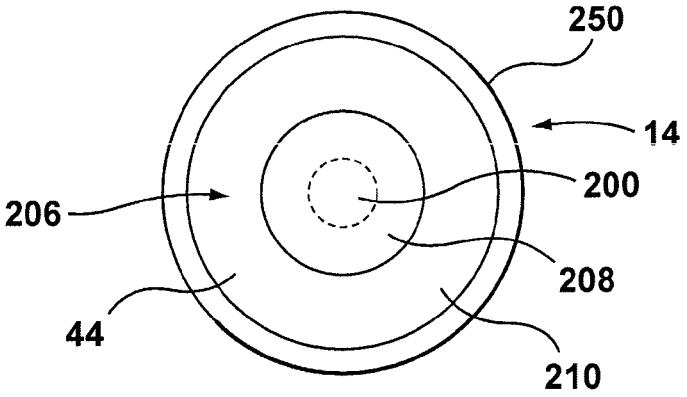
FIG. 17 is a top view of the filter as formed for the beverage capsule shown in FIG. 16 showing the inner portion and outer portion of filter.

Referring to FIG. 17, a top view of the filter 14 for the embodiment of capsule 10 in FIG. 16 is shown. The figure shows the location where boss 200 engages bottom portion 44 of filter 14 to form tented filter zone 206 with raised inner portion 208 and lower outer portion 210.

Referring to FIG. 18, a boss element 254 adapted for resting on end wall 22 is shown. Boss element 254 includes an annular footing 256, side ribs 258 and tip 204 defining diffusing surface 220. Boss element 254 is adapted for use in a standard cup-shaped body 12 instead of integrally molding a boss into end wall 22. Diffusing surface 220 preferably is concave in shape but other suitable diffusing structures may be utilized.

Referring to FIG. 19, a diffusing element 260 adapted for resting on flange 28 of capsule 10 is shown. Diffusing element 260 includes an annular flange 262, side ribs 264 and diffusing surface 220. Diffusing element 260 is adapted for use in a body 12 of a capsule 10, such as a conventional beverage capsule, where diffusion of fluid to better saturate ingredients is desired and no boss 200 or boss element 254 is provided. Diffusing surface 220 preferably is concave in shape but other suitable diffusing structures may be utilized.

While the above description provides examples of one or more processes or apparatuses, it will be appreciated that other processes or apparatuses may be within the scope of the accompanying claims.

We claim:

1. A beverage capsule intended for use in a beverage preparing machine, said beverage capsule comprising:
- a body having a side wall extending from an end wall to an opening to define an interior space, said end wall including an extraction region that is constructed and arranged to be pierced to facilitate flow of beverage from said capsule;
- a filter disposed in said body to define an ingredients chamber, located between said opening and said filter, and an extraction chamber located between said filter and said end wall;
- a boss extending from said end wall into said interior space, said boss engaging said filter to define a tented filter zone wherein an inner portion of said filter is spaced a further distance from said end wall than an outer portion of said filter;
- one or more ingredients disposed in said ingredients chamber for preparing a desired beverage;
- a cover for covering said opening; and
- a diffusing surface disposed in said body beneath a surface of said ingredients, said diffusing surface being constructed and arranged to engage and diffuse a laminar stream of fluid that enters the capsule during use in a beverage preparing machine.

2. The beverage capsule of claim 1, wherein said diffusing surface is constructed and arranged to redirect fluid that engages said diffusing surface to desired locations within said capsule.

3. The beverage capsule of claim 1, wherein said diffusing surface is concave in shape.

4. The beverage capsule of claim 1, wherein said diffusing surface is defined on the portion of said boss that engages said filter.

5. The beverage capsule of claim 1, wherein said boss defines an engagement surface having a plurality of arms for engaging a bottom surface of said filter during use.

6. The beverage capsule of claim 5, wherein said engagement surface is star shaped.

7. The beverage capsule of claim 1, wherein said boss includes a plurality of channels extending at least partially between an engagement surface, where said boss engages said filter, and said end wall.

8. The beverage capsule of claim 1, wherein said boss is integrally formed with said end wall.

9. The beverage capsule of claim 1, further comprising at least one capsule key disposed on an exterior surface of said body for fitting to a corresponding at least one machine key element disposed on an interior surface of a capsule receiving chamber of a beverage preparing device for positioning the capsule in a desired orientation within said receiving chamber.

10. The beverage capsule of claim 1, wherein said diffusing surface is disposed at no less than 20% and no more than 80% of the height of the capsule as measured from said end wall to said opening.

11. A beverage capsule intended for use in a beverage preparing machine, said beverage capsule comprising:
- a body having a side wall extending from an end wall to an opening to define an interior space;
- a filter disposed in said body to define an ingredients chamber;
- one or more ingredients disposed in said ingredients chamber for preparing a desired beverage;
- a cover for covering said opening; and
- a diffusing surface disposed beneath a surface of said ingredients, said diffusing surface being constructed and arranged to engage and diffuse a laminar stream of fluid that enters the capsule during use in a beverage preparing machine.

12. The beverage capsule of claim 11, wherein said diffusing surface is constructed and arranged to redirect fluid that engages said diffusing surface to desired locations within said capsule.

13. The beverage capsule of claim 11, wherein said diffusing surface is concave in shape.

14. The beverage capsule of claim 11, wherein said diffusing surface is defined on the portion of said boss that engages said filter.

15. The beverage capsule of claim 11, wherein said diffusing surface is disposed at no less than 20% and no more than 80% of the height of the capsule as measured from said end wall to said opening.

* * * * *